US005921400A

United States Patent [19]

Judd

[11] Patent Number: 5,921,400

[45] Date of Patent: Jul. 13, 1999

[54] APPARATUS FOR SIEVING A PARTICULATE MATERIAL

[76] Inventor: Melvyn John Judd, 5 Oldknow Crescent, Singleton NSW 2330, Australia

[21] Appl. No.: 08/836,673

[22] PCT Filed: Nov. 27, 1995

[86] PCT No.: PCT/AU95/00785

§ 371 Date: Jul. 16, 1997

§ 102(e) Date: Jul. 16, 1997

[87] PCT Pub. No.: WO96/16748

PCT Pub. Date: Jun. 6, 1996

[30] Foreign Application Priority Data

Nov. 25, 1994 [AU] Australia ..... PM 9692

[51] Int. Cl.[6] ..... B07B 1/26; B07B 1/42

[52] U.S. Cl. ..... 209/287; 209/289; 209/365.4; 209/386; 209/387

[58] Field of Search ..... 209/243, 244, 209/246, 284, 288, 289, 290, 366, 287, 364, 365.1, 365.4, 386, 387

[56] References Cited

U.S. PATENT DOCUMENTS

| | | | |
|---|---|---|---|
| 2,245,650 | 6/1941 | Christopherson | 209/287 |
| 2,249,109 | 7/1941 | Botimer | 209/246 X |
| 2,804,975 | 9/1957 | Liebhart et al. | 209/287 |
| 4,585,354 | 4/1986 | Thesenfitz | 209/290 X |
| 4,636,304 | 1/1987 | Hoppe | 209/287 |
| 4,896,835 | 1/1990 | Fahrenholz | 209/287 X |

FOREIGN PATENT DOCUMENTS

| | | | |
|---|---|---|---|
| 816570 | 3/1981 | U.S.S.R. | 209/287 |

*Primary Examiner*—Tuan N. Nguyen

*Attorney, Agent, or Firm*—Dennison, Meserole, Pollack & Scheiner

[57] ABSTRACT

An apparatus for sieving a particulate material into selected size fractions. This apparatus includes a screen for separating the particulate material into an undersize fraction and an oversize fraction, and having an inlet end and an outlet end. The apparatus further includes a rotating/oscillating drive for rotating or oscillating the screen about an axis thereof, and a twin phase drive for driving the screen in a vertical direction and an axial direction.

16 Claims, 6 Drawing Sheets

APPARATUS FOR SIEVING A PARTICULATE MATERIAL

BACKGROUND OF THE INVENTION

The present invention relates to an apparatus for sieving a particulate material into selected size fractions.

The present invention relates particularly, although by no means exclusively, to an apparatus for sieving diamonds into selected size fractions.

The conventional apparatus for sieving diamonds into selected size fractions comprises an assembly of vibrating screens that are arranged in a stack with the uppermost screen having the largest screen size and successive screens having progressively finer screen sizes.

The conventional apparatus is operated on a batch basis and, as a consequence, the apparatus generally is not compatible with upstream and downstream diamond processing steps which are usually operated on a continuous basis. Another disadvantage of the conventional apparatus is that the screens block readily due to diamonds becoming lodged in holes in the screens ("pegged"). As a consequence, pegged diamonds must be removed from the screen holes periodically to maintain optimum performance of the screens. In addition to this being a time-consuming and labour intensive exercise, there is generally a degradation of product caused by diamonds being broken during the de-pegging operation. Other disadvantages of the conventional apparatus are high noise and dust levels.

SUMMARY OF THE INVENTION

An object of the present invention is to provide an apparatus for sieving diamonds into selected size fractions which alleviates the disadvantages of the conventional apparatus described in the preceding paragraph.

According to the present invention there is provided an apparatus for sieving a particulate material into selected size fractions comprising:

(a) a screen for separating the particulate material into an undersize fraction and an oversize fraction, the screen having an inlet and for introducing particulate material to the screen and an outlet and for discharging the oversize fraction;

(b) a means for receiving the undersize fraction from the screen;

(c) a drive means for rotating or oscillating the screen about an axis of the screen; and (d) a twin phase drive means coupled to the screen for driving the screen in two directions.

The applicant has found that the motion of particulate material in the screen that is caused by the twin phase drive means substantially increases the path length of the particulate material in the screen and, thereby, greatly increases the opportunity for particles to pass through the screen.

In addition, the applicant has found that the overall motion of the particulate material in the screen caused by the combined effect of the twin phase drive means and the rotating/oscillating drive means increases the overall movement of particles in the screen and this minimises pegging of particulate material in the screen.

It is preferred that the twin phase drive means be coupled to the screen for driving the screen in two orthogonal directions.

It is preferred that the twin phase drive means be coupled to the screen for driving the screen in a vertical direction and an axial direction of the screen for imparting vertical and axial motion to the particulate material as the particulate material moves from the inlet end toward the outlet end.

It is preferred that the screen be supported with the axis of the screen horizontal.

With such an arrangement, it is preferred that the twin-phase drive means be coupled to the screen for driving the screen vertically and horizontally for imparting vertical and horizontal motion to the particulate material.

The horizontal motion of the particulate material which results from the drive applied to the screen may be in a forward direction only, i.e. in an axial direction towards the outlet end of the screen, or it may be such that there are components of forward and reverse motion.

It is noted that for each particle at various times there may be no imparted horizontal motion, with the only motion of the particles being vertical and rotational/oscillatory.

It is preferred that the rotating/oscillating drive means and the twin phase drive means be adapted to impart a tumbling motion to the particulate material so that the orientation of the particulate material with respect to the screen holes changes continually as the particulate material travels through or along the screen to increase the probability of a particle passing through the screen.

The apparatus may be operated on a continuous basis.

It is preferred that the screen be cylindrical.

The screen may comprise a series of cylindrical sections having different screen sizes.

Alternatively, the screen may be channel-shaped. With such an arrangement, the screen walls may be curved or straight sections.

It is preferred that the twin phase drive means comprise a first drive means for reciprocating the screen in a first direction and a second drive means for reciprocating the screen in a second direction.

It is preferred particularly that the first direction be vertical and the second direction be the axial direction.

It is preferred more particularly that the second direction be horizontal.

It is preferred that the apparatus comprise a control means for independently controlling the rate of feed of particulate material to the screen.

It is preferred that the apparatus further comprises a control means for selectively controlling one or more of the frequency, amplitude, and phase of each of the first and second drive means.

It is preferred particularly that the control means be adapted to control one or more of the frequency, amplitude, and phase of one of the drive means independently of the other drive means.

It is preferred that the apparatus further comprises a control means for selectively controlling the rate of rotation/oscillation of the rotating/oscillating drive means.

It is preferred that the apparatus further comprises a de-pegging means positioned externally of the screen.

The de-pegging means may be any suitable means.

It is particularly preferred that the de-pegging means be adapted to change the orientation of pegged particulate material so that the pegged particles are subsequently released under the influence of gravity.

Typically, the de-pegging means comprises a brush and a means to reciprocate the brush axially to move the brush across the outer surface of the screen.

BRIEF DESCRIPTION OF THE DRAWINGS

The present invention is described further by a way of example with reference to the accompanying drawings in which.

DESCRIPTION OF THE PREFERRED EMBODIMENTS

Figure 1:
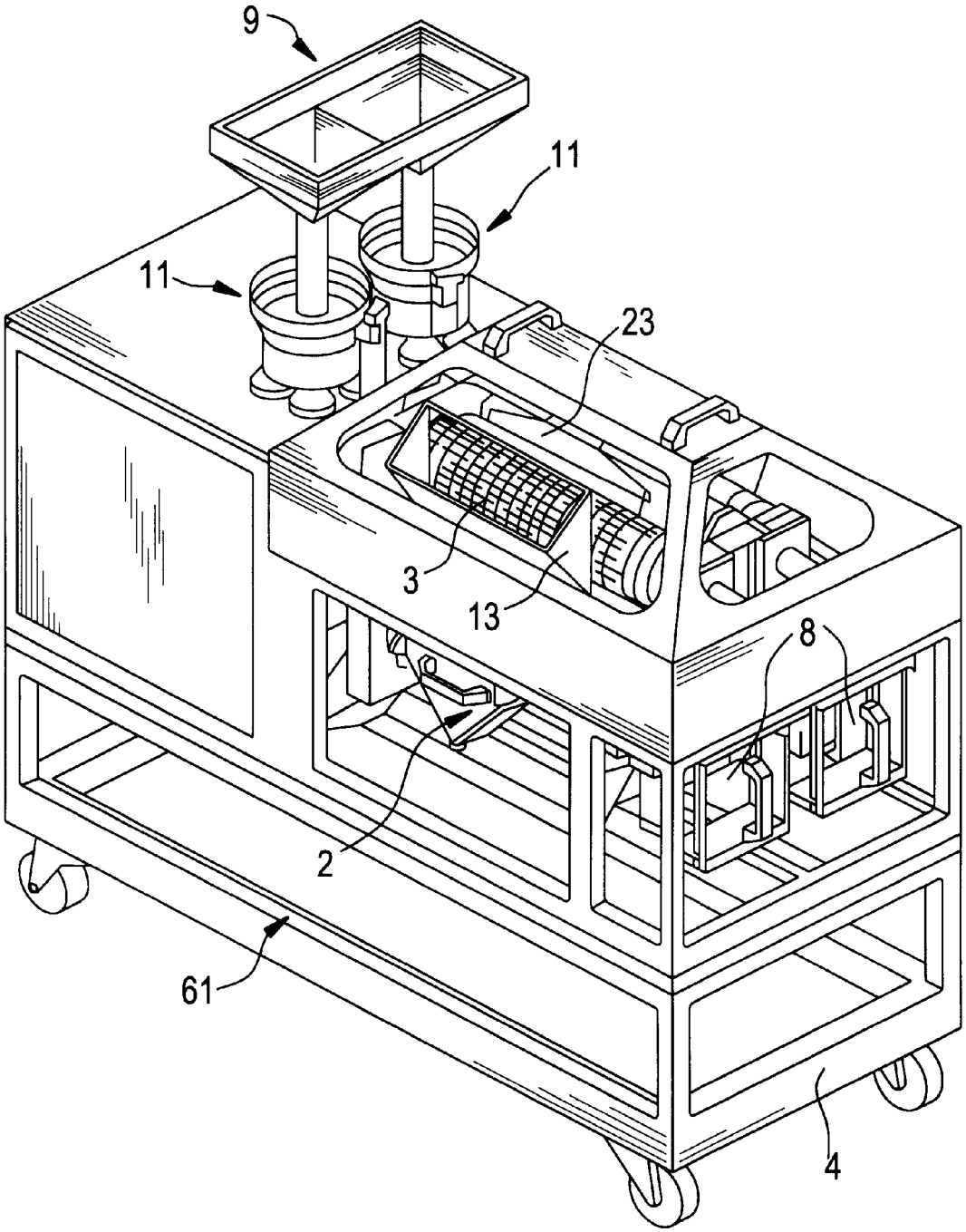
FIG. 1 is a perspective view of a preferred embodiment of an apparatus in accordance with the present invention.
Figure 2:
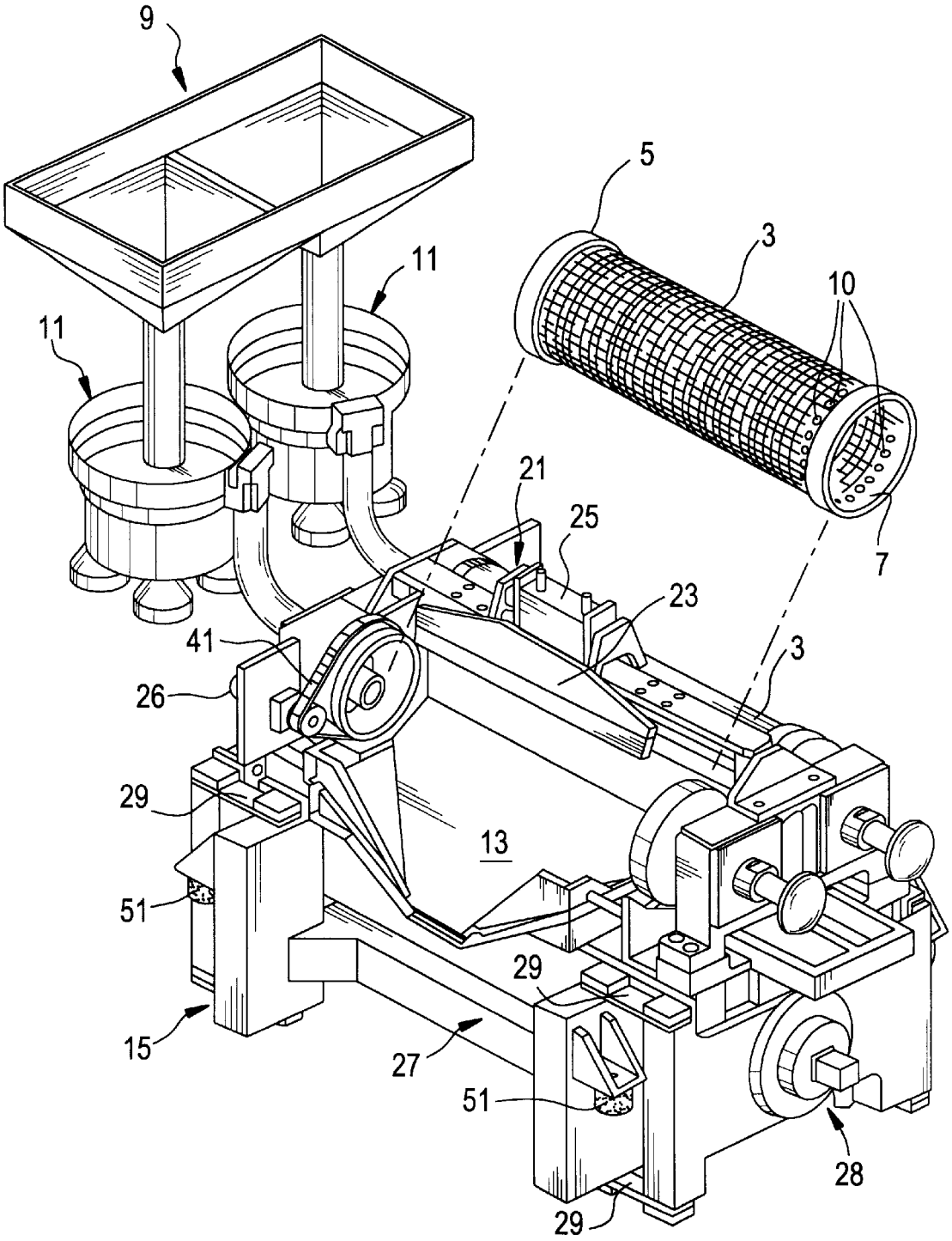
FIG. 2 is a perspective view from the front of the main components of the apparatus shown in FIG. 1 with the safety cover removed and one of the screens in a raised position for clarity.
Figure 3:
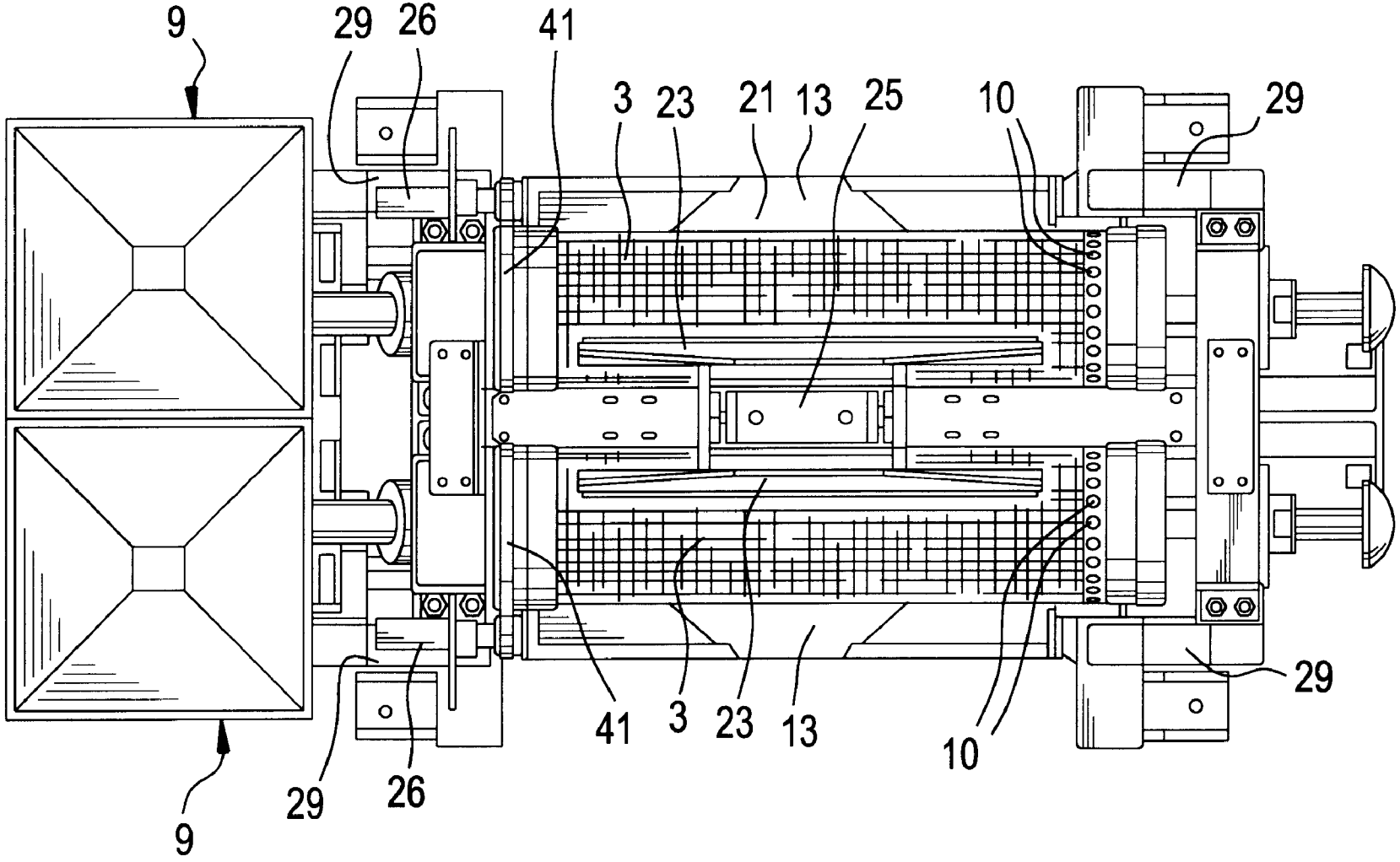
FIG. 3 is a top plan view of the main components of the apparatus as shown in FIG. 2 with both screens in operative positions.
Figure 4:
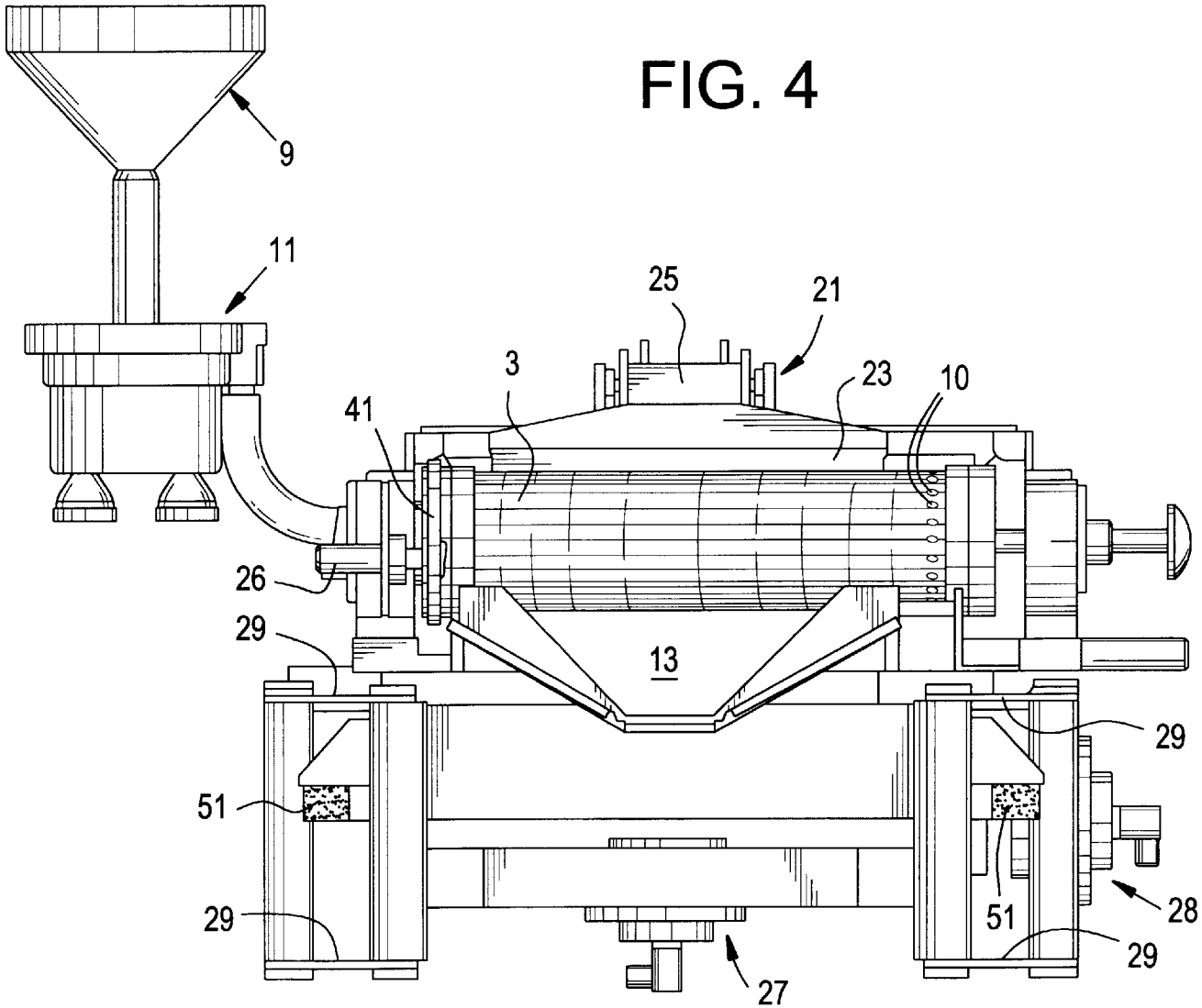
FIG. 4 is a side elevation of the main components of the apparatus as shown in FIG. 3.
Figure 5:
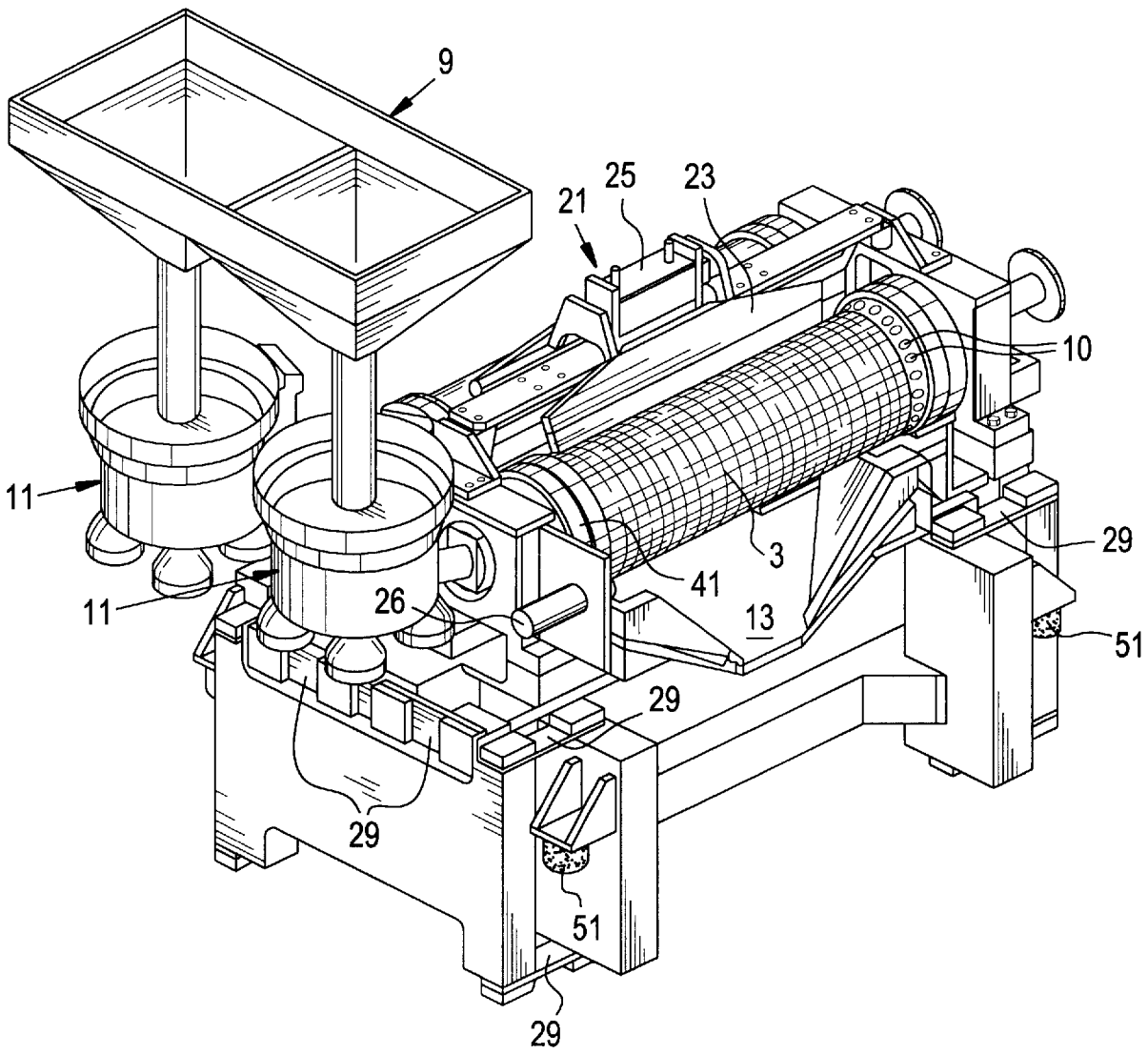
FIG. 5 is a perspective view from the rear of the main components of the apparatus shown in FIG. 3.
Figure 6:
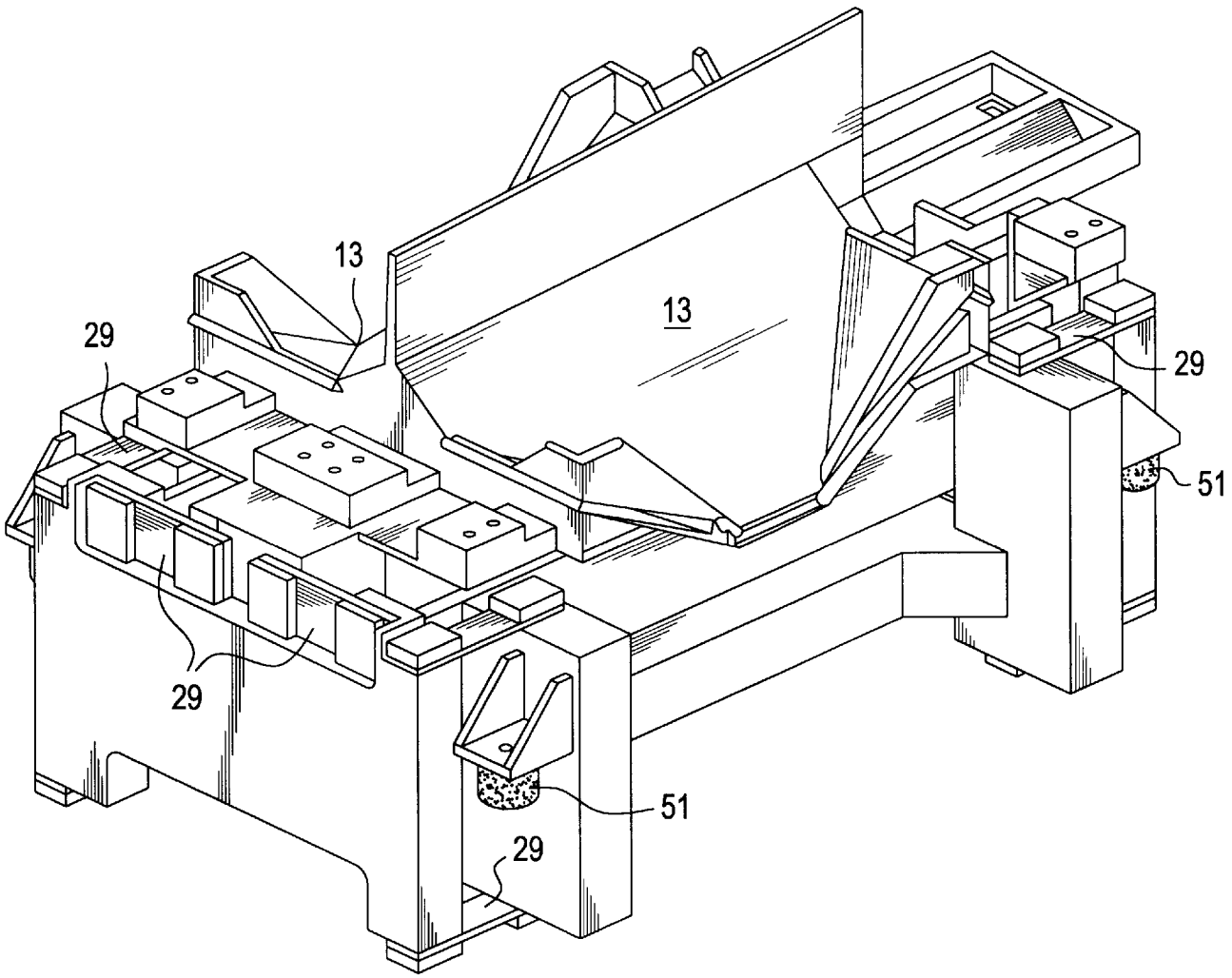
FIG. 6 is a perspective view from the rear of selected main components of the apparatus shown in FIG. 3.

The apparatus shown in FIGS. 1 to 6 is suited particularly for sorting diamonds into selected size fractions and is described in this context. However, it is noted that the apparatus of the present invention is not limited to this application and may be used to sort any suitable particulate material.

The apparatus shown in FIGS. 1 to 6 includes two separate identical screen assemblies and in order to simplify the following description of the apparatus there is a reference only to one of these assemblies.

With reference to the Figures, the apparatus comprises a horizontally disposed cylindrical screen 3 which has an inlet end 5 for receiving diamonds and an outlet end 7 for discharging over-sized diamonds into an oversize product bin or hopper 8. In relation to the outlet end 7 it is noted that the oversized diamonds are discharged through a series of relatively large holes 10 in the screen 3 a spaced intervals around the circumference of the screen 3 at the outlet end 7 of the screen 3.

The apparatus further comprises a feed hopper 9 for receiving diamonds on a batch or a continuous basis and a bowl feeder 11 positioned below the feed hopper 9 for accurately transferring, diamonds from the feed hopper 9 into the inlet end 5 of the screen 3.

The apparatus further comprises a chute 13 positioned beneath the screen 3 for receiving undersized diamonds that pass through the screen 3 and for transferring the diamonds to an undersized bin 2.

In a particularly advantageous embodiment (not shown), the screen 3 comprises a series of cylindrical sections of different screen sizes to screen diamonds into different size fractions as the diamonds move along the length of the screen 3 from the inlet end 5 towards the outlet end 7. In this embodiment, a separate chute is provided for each screen section to receive each size fraction of diamonds.

With further reference to the Figures, the screen 3 is supported for rotation about the central elongate axis of the screen 3. In this connection, the apparatus further comprises a drive means 26 which comprises an electric motor that transfers drive via a belt 41 to rotate the screen 3 about the central axis.

Furthermore, the apparatus comprises:

a twin-phase drive assembly, generally identified by the numeral 15, comprising a first drive means 27 for reciprocating the screen 3 vertically and a second drive means 28 for reciprocating the screen 3 horizontally for imparting vertical and horizontal motion, respectively, to diamonds as the diamonds move towards the outlet end 7 of the screen 3; and a control means (not shown) for selectively controlling one or more of the frequency, amplitude, and phase of each of the first and the second drive means 27, 28 as may be required for optimum operation of the apparatus.

The first and the second drive means 27, 28 are coupled to the screen 3 by means of a series of springs 29, and the drive is transferred to the screen 3 via the springs 29.

Furthermore, the assembly of the screen 3 and the first and second drive means 27, 28, are mounted via vibration isolating blocks 51 to a support framework 61.

It is noted that the optimum operation of the apparatus will depend on a number of factors including but not limited to the weight of the diamonds being processed and the size distribution of the diamonds. In some situations, the optimum operation may be achieved by controlling the first and the second drive means 27, 28 so that the diamonds move upwardly and downwardly and in a forward axial direction toward the outlet end 7. Alternatively, the optimum operation may be achieved by causing the diamonds to move upwardly and downwardly and in the forward and reverse axial directions, with net forward axial movement. In addition, in either case, the optimum operation may be achieved by controlling the first and the second drive means 27, 28 so that at given points in time the diamonds move upwardly and downwardly only with no net forward or reverse axial motion.

It is also noted the in addition to the vertical motion of the diamonds, the combined effect of the rotary drive means 26 and the twin phase drive means 15 is to cause the diamonds to move with a tumbling motion.

The apparatus further comprises a diamond de-pegging assembly, generally identified by the numeral 21, for de-pegging diamonds from the screen 3. The assembly 21 comprises a brush 23 and a drive means 25 in the form of a double-acting cylinder for reciprocating the brush 23 axially against the outer surface of the screen 3. The brush 23 causes a change of the orientation of pegged diamonds which is sufficient to release the pegged diamonds under the influence of gravity a the screen 3 rotates about the central axis.

The applicant has found that the use of the apparatus described above, particularly as a consequence of the provision of a twin phase drive means 15, substantially reduces the time required to screen diamonds into selected size fractions when compared with the conventional vibrating screens.

In addition, as indicated previously, the applicant has found that the increased path length of diamonds in the screen that is caused by the motion of the screen 3 as a consequence of the twin phase drive means 15 increases the probability of diamonds being exposed to a hole in the screen 3 and, therefore, the apparatus screens diamonds in an efficient and effective manner.

Furthermore, as indicated previously, the apparatus can be operated on a continuous basis and such operation is compatible with typical upstream and downstream diamond processing operations.

In addition, the applicant has found that the apparatus described above enables more accurate sieving of diamonds than is possible with the conventional vibrating screens.

Many modifications may be made to the preferred embodiment of the apparatus of the present invention described above without departing from the spirit and scope of the present invention.

By way of example, whilst the preferred embodiment comprises a cylindrical screen 3 it is noted that the present invention is not so limited and the screen may be of any suitable configuration. By way of particular example, the screen 3 may be an open-topped channel-shaped member which is supported to oscillate about a central axis.

What is claimed is:

1. An apparatus for sieving a particulate material into selected size fractions comprising:

(a) a screen for separating the particulate material into an undersize fraction and an oversize fraction, the screen having an inlet end for introducing particulate material to the screen and an outlet end for discharging the oversize fraction;

(b) a means for receiving the undersize fraction from the screen;

(c) a rotating drive means for rotating or oscillating the screen about an axis of the screen; and (d) an additional, twin phase drive means coupled to the screen for driving the screen in two directions, in a first direction along said axis of the screen and in a second direction orthogonal thereto for imparting a generally vertical motion.

2. The apparatus defined in claim 1 wherein the screen is supported with the axis of the screen horizontal.

3. The apparatus defined in claim 2 wherein the twin-phase drive means is coupled to the screen for driving the screen vertically and horizontally for imparting vertical and horizontal motion to the particulate material.

4. The apparatus defined in claim 1 wherein the rotating drive means and the twin phase drive means are adapted to impart a tumbling motion to the particulate material so that the orientation of the particulate material with respect to the screen holes changes continually as the particulate material travels through or along the screen.

5. The apparatus defined in claim 1 wherein the screen comprises a series of cylindrical sections having different screen sizes.

6. The apparatus defined in claim 1 wherein the screen is channel-shaped.

7. The apparatus defined in claim 1 wherein the twin phase drive means comprises a first drive means for reciprocating the screen in the first direction and a second drive means for reciprocating the screen in the second direction.

8. The apparatus defined in claim 1 further comprising a control means for independently controlling the rate of feed of particulate material to the screen.

9. The apparatus defined in claim 7 further comprising a control means for selectively controlling one or more of the frequency, amplitude, and phase of each of the first and second drive means.

10. The apparatus defined in claim 9 wherein the control means is adapted to control one or more of the frequency, amplitude, and phase of one of the first and second drive means independently of the other drive means.

11. The apparatus defined in claim 1 further comprising a control means for selectively controlling rotation rate of the rotating/oscillating drive means.

12. The apparatus defined in claim 1 further comprising a de-pegging means positioned externally of the screen.

13. The apparatus defined in claim 12 wherein the de-pegging means is adapted to change the orientation of pegged particles so that the pegged particles are subsequently released under the influence of gravity.

14. The apparatus defined in claim 13 wherein the de-pegging means comprises a brush and a means to reciprocate the brush axially to move the brush across the screen on its outer surface.

15. The apparatus as defined in claim 1, wherein the twin phase drive means is a reciprocating drive means.

16. The apparatus as defined in claim 1, wherein the rotating drive means is a reciprocating drive means, causing the screen to oscillate about its rotational axis.

* * * * *